US007603822B2

(12) United States Patent
Kosny et al.

(10) Patent No.: US 7,603,822 B2
(45) Date of Patent: Oct. 20, 2009

(54) PANELIZED WALL SYSTEM WITH FOAM CORE INSULATION

(75) Inventors: Jan Kosny, Oak Ridge, TN (US); Sally Gaskin, Houston, TX (US)

(73) Assignee: UT-Battelle, LLC, Oak Ridge, TN (US)

( * ) Notice: Subject to any disclaimer, the term of this patent is extended or adjusted under 35 U.S.C. 154(b) by 555 days.

(21) Appl. No.: 11/234,397

(22) Filed: Sep. 23, 2005

(65) Prior Publication Data

US 2007/0094967 A1 May 3, 2007

(51) Int. Cl.
*E04B 1/38* (2006.01)

(52) U.S. Cl. ..... 52/282.1; 52/282.4; 52/794.1

(58) Field of Classification Search ..... 52/309, 52/309.9, 309.16, 720.1, 730.1, 731.8, 731.9, 52/733.2, 736.1, 736.4, 737.5, 738.1, 73, 52/782.1, 794.1, 571, 582.1, 588.1, 584.1; 425/4 R; 252/282.1, 282.4

See application file for complete search history.

(56) References Cited

U.S. PATENT DOCUMENTS 3,251,163 A * 5/1966 Russell ..... 52/263
4,099,355 A * 7/1978 Strunk ..... 52/404.3
4,104,840 A * 8/1978 Heintz et al. ..... 52/309.9
4,295,304 A * 10/1981 Kim ..... 52/91.1
4,637,190 A * 1/1987 Minialoff et al. ..... 52/579
4,754,587 A * 7/1988 Glaser ..... 52/282.4
4,858,403 A * 8/1989 Lingle ..... 52/127.12
5,293,728 A * 3/1994 Christopher et al. ..... 52/588.1
5,373,678 A * 12/1994 Hesser ..... 52/592.1
5,497,589 A * 3/1996 Porter ..... 52/309.7
5,509,242 A * 4/1996 Rechsteiner et al. ..... 52/270
5,533,311 A * 7/1996 Tirrell et al. ..... 52/309.9
5,612,117 A * 3/1997 Belanger et al. ..... 428/178
5,644,878 A * 7/1997 Wehrmann ..... 52/287.1
5,743,055 A * 4/1998 Conner et al. ..... 52/282.2
5,771,645 A * 6/1998 Porter ..... 52/220.2
6,085,469 A * 7/2000 Wolfe ..... 52/71
6,122,879 A * 9/2000 Montes ..... 52/592.1
6,279,287 B1 * 8/2001 Meadows ..... 52/589.1
6,279,290 B1 * 8/2001 Richardson ..... 52/208
6,619,008 B1 * 9/2003 Shivak et al. ..... 52/282.1
6,802,157 B2 * 10/2004 Hallsten ..... 52/3
2003/0172613 A1 * 9/2003 Fontana et al. ..... 52/731.5
2005/0055982 A1 * 3/2005 Medina ..... 52/782.1
2005/0163881 A1 * 7/2005 Pierick et al. ..... 425/4 R
2005/0166496 A1 * 8/2005 Farag ..... 52/204.57
2005/0204699 A1 * 9/2005 Rue ..... 52/794.1
2007/0234649 A1 * 10/2007 Near et al. ..... 52/73
2007/0294976 A1 * 12/2007 Fay ..... 52/515
2008/0047217 A1 * 2/2008 Browning et al. ..... 52/588.1

* cited by examiner

*Primary Examiner*—Richard E Chilcot, Jr.
*Assistant Examiner*—Alp Akbasli
(74) *Attorney, Agent, or Firm*—Gregory A. Nelson; Novak Druce + Quigg LLP

(57) ABSTRACT

A wall system includes a plurality of wall members, the wall members having a first metal panel, a second metal panel, and an insulating core between the first panel and the second panel. At least one of the first panel and the second panel include ridge portions. The insulating core can be a foam, such as a polyurethane foam. The foam can include at least one opacifier to improve the k-factor of the foam.

19 Claims, 16 Drawing Sheets

PANELIZED WALL SYSTEM WITH FOAM CORE INSULATION

STATEMENT REGARDING FEDERALLY SPONSORED RESEARCH OR DEVELOPMENT

The United States Government has rights in this invention pursuant to Contract No. DE-AC05-00OR22725 between the United States Department of Energy and UT-Battelle, LLC.

CROSS-REFERENCE TO RELATED APPLICATIONS

Not applicable.

BACKGROUND OF THE INVENTION

Buildings consume 36% of the total energy consumed in the US and two-thirds of the electricity generated nationally. A building envelope technology that can reduce space conditioning energy consumption significantly will have a significant impact on the energy consumption. Another significant attribute of an improved building construction system is that it should require generally unskilled labor for the envelope construction.

Current structural insulated panels (SIPs) are Oriented Strand Board (OSB) clad, polystyrene foam core, 4×8' panels. The OSB outer skin is not impervious to termites nor moisture. In order to achieve the desired R-value of at least R-20, the polystyrene core has to be generally 6" thick. This thickness creates compatibility problems with other structural components such as windows and door frames, and are therefore more expensive and not readily available. The OSB clad SIPS are heavy, sometimes 90-100 lbs, or 2.8 to 3 lbs/sf. In most existing SIP technologies, the interlocking panel-connecting mechanism is not easily assembled and is not airtight. Construction requires uniquely skilled contractors and a crane to install roof panels on even single story buildings. These characteristics add up to higher construction costs, slower production and long term maintenance issues relating to termites, moisture related wood deterioration, and indoor air quality issues from organic resins and mold contamination.

BRIEF DESCRIPTION OF THE DRAWINGS

A fuller understanding of the present invention and the features and benefits thereof will be obtained upon review of the following detailed description together with the accompanying drawings, in which.

SUMMARY OF THE INVENTION

A wall system comprises a wall member having a first metal panel, a second metal panel, and an insulating core between the first panel and the second panel. At least one of the first panel and the second panel comprise ridge portions.

A phase change material can be provided between said first panel and a wall finish material attached to the first material. A radiant barrier material can be provided on the first panel facing the wall finish material.

A structural column has a facing member having angled connection portions, and a channel member having angled connection portions connected to the angled connection portions of the facing member. The channel portions form channels between the facing member and the channel member.

The insulating core can be a foam. The foam can be a closed cell polyurethane foam. The foam can comprise an opacifier.

A wall member has a first metal panel, a second metal panel, and an insulating core between the first panel and the second panel. At least one of the first panel and the second panel comprise ridge portions.

A structural column construction comprises a facing member having angled connection portions, and a channel member having angled connection portions connected to the angled connection portions of the facing member. The channel portions form channels between the facing member and the channel member.

DETAILED DESCRIPTION

Figure 1:
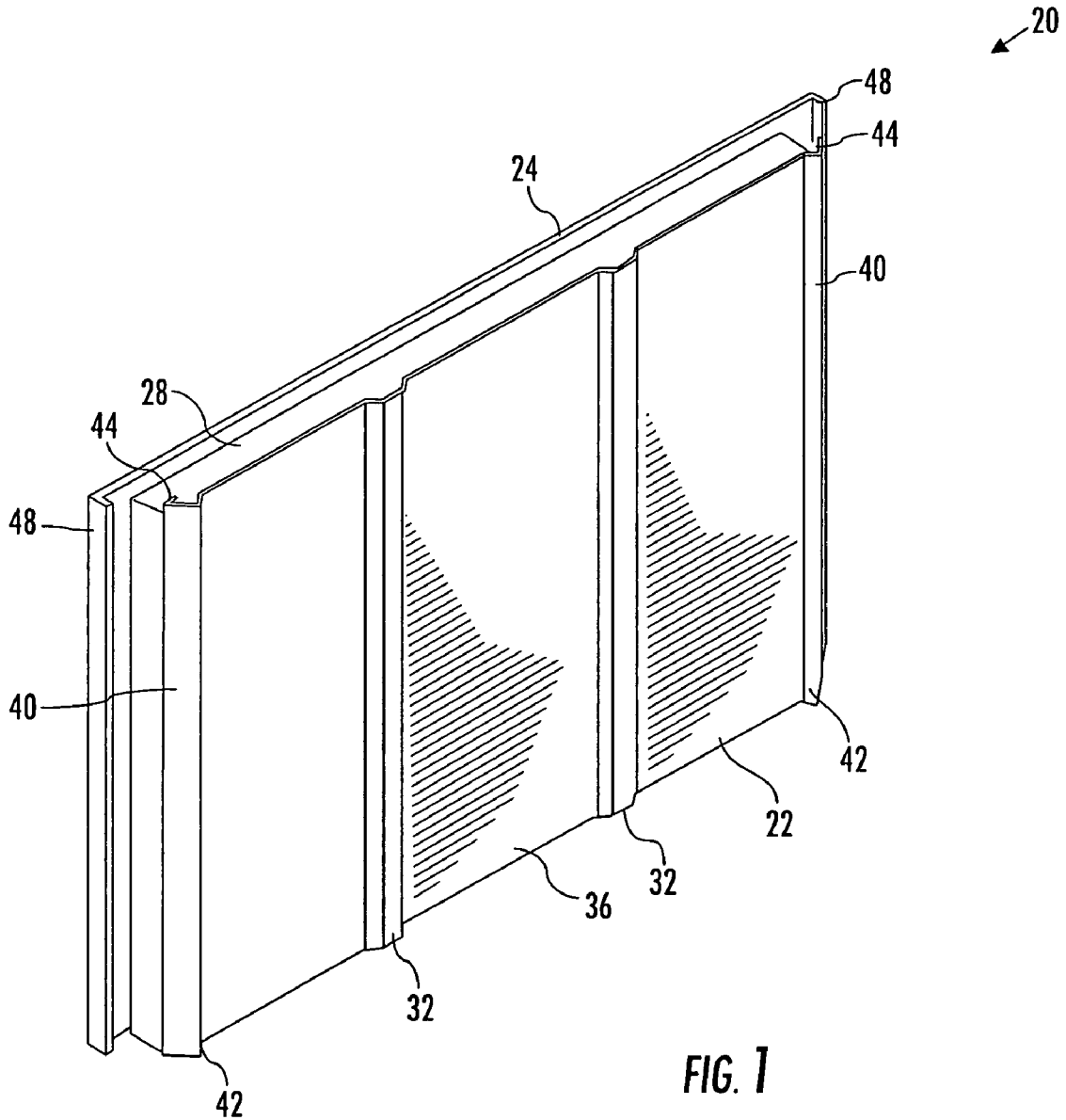
FIG. 1 is a perspective view of a wall panel according to the invention.

The invention provides a panel construction for a wall system that is modular and can be scaled to any height of building. There is shown in FIG. 1 a wall member 20 having a first panel 22, a second panel 24, and an insulating core 28 between the first panel 22 and second panel 24. Ridges 32 are provided on at least one of the first panel 22 and second panel 24. The ridges 32 provide rigidity to the wall member and also form a surface for the attachment of wall board such as gypsum or other suitable materials. The space 36 between the ridges 32 and behind the wall finish material, such as gypsum board (not shown), can be used to route electrical wire, plumbing, insulation, moisture barriers, phase change material boards, a radiant barrier, or to provide for ventilation.

The first panel 22 and second panel 24 can be made of any suitable material. In one aspect, the material is a steel, such as 24 or 26 gauge steel. This light gauge steel is noncombustible and impregnable to the foam material used for the core 28, and has sufficient structural strength to provide rigidity and strength to the resulting structure, and superior wind performance. Other materials are possible such as aluminum, cemetitious boards, and reinforced plastic composites.

The insulating core material is selected to be light weight, fire resistant, insulating, moisture resistant, and impervious to termites. In one aspect, the foam is a polyurethane foam. Other foams can also be used in production of this panel technology. The polyurethane foam can include an infrared opacifier which will reduce radiant heat transfer within the foam cells. The incorporation of an opacifier in cellular insulation reduces the radiation transport of heat through the foam by as much as 50% or more, with a resultant reduction in the overall heat flux in the range of 10-20%. Common opacifiers used in the past for similar applications include titanium dioxide, calcium sulfate, iron oxide, kaolin clay, calcium carbonate, mica, and carbon black. The opacifier must be capable of lowering the k-factor initially and after aging of the foam for at least 90 days. In case of polyurethane foams blown with pentanes, the potential increase of thermal resistivity would be between R-0.6 to R-1.2 (an increase from R-5.8 to up to R-7.0 per in). A description of such materials is provided in U.S. Pat. No. 4,795,763, the disclosure of which is incorporated by reference.

Thermal mass effect in the proposed panels will be provided by thermally active inserts containing phase change material (PCM). PCM-board technology can utilize microencapsulated Phase Change Material (PCM) as thermal mass components. The ability of PCMs to reduce peak loads is well documented. The PCM can be impregnated into the foam, or can be otherwise positioned in foam board or fiberboard that is included in the panels. An example of suitable PCMs are microencapsulated paraffinic hydrocarbons.

The dimensions of the panel 20 can be of any suitable size. Current structural insulated panels are very often 4'×8' or a multiple of 4'×8', and owing to the use of a polystyrene foam core, generally 3" to 6" thick. According to the invention, the panels can be 4" thick (4.5" with gypsum board interior finish). The panels can be of any height, and can be manufactured in any width, but for building purposes are generally in 4' or 2' widths (with included panel column). The ridges 32 can be spaced 16" apart on center, the typical spacing of wood wall studs, in order to permit use of conventional building materials and techniques to attach various features to the walls. For an 8' panel, the panels of the invention will be light-weight, 2-2.3 lbs per square foot. Other dimensions are possible.

The panel 22 can have angled flange portions 40, 42 for connecting to structural columns. Inwardly directed flange portions 44 can be utilized to secure the foam 28. The panel 24 can have inwardly directed flange portions 48 for connecting to adjacent structural columns, corner pieces, or other members.

Figure 2:
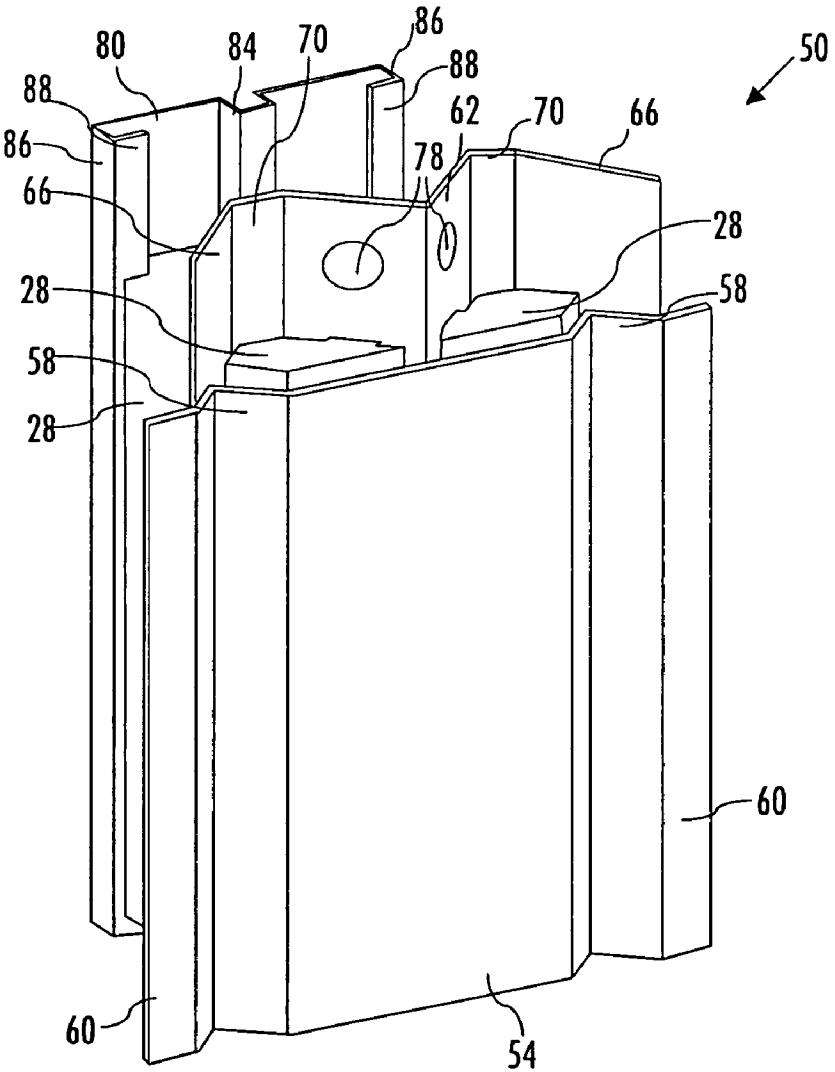
FIG. 2 is a perspective view of a structural column according to the invention.

There is shown in FIG. 2 a structural column according to the invention. The structural column 50 comprises a facing member 54 having angled connection portions 58. A channel member 62 includes angled flange portions 66 adapted for connection to the angled connection portions 58 of the facing member 54. Channel portions 70 of the channel member 62 form channels between the facing member 54 and channel member 62. These channels can receive insulating foam 28 which can be blown or otherwise positioned in the channels through apertures 78 in the channel member 62. A connector 80 can be provided for connecting adjacent panels 20 together and for connecting panels 20 to other structural members of the system. A groove 84 can be provided to receive flanges 48 from the panels 20. The connector 80 is positioned in spaced-apart relation to the channel member 62 so as to permit the placement of insulating foam 28 between the connector 80 and channel member 62. Side flanges 86 lead to inwardly directed flanges 88 which can be provided on the connector 80 in order to engage the foam 28.

Figure 3:
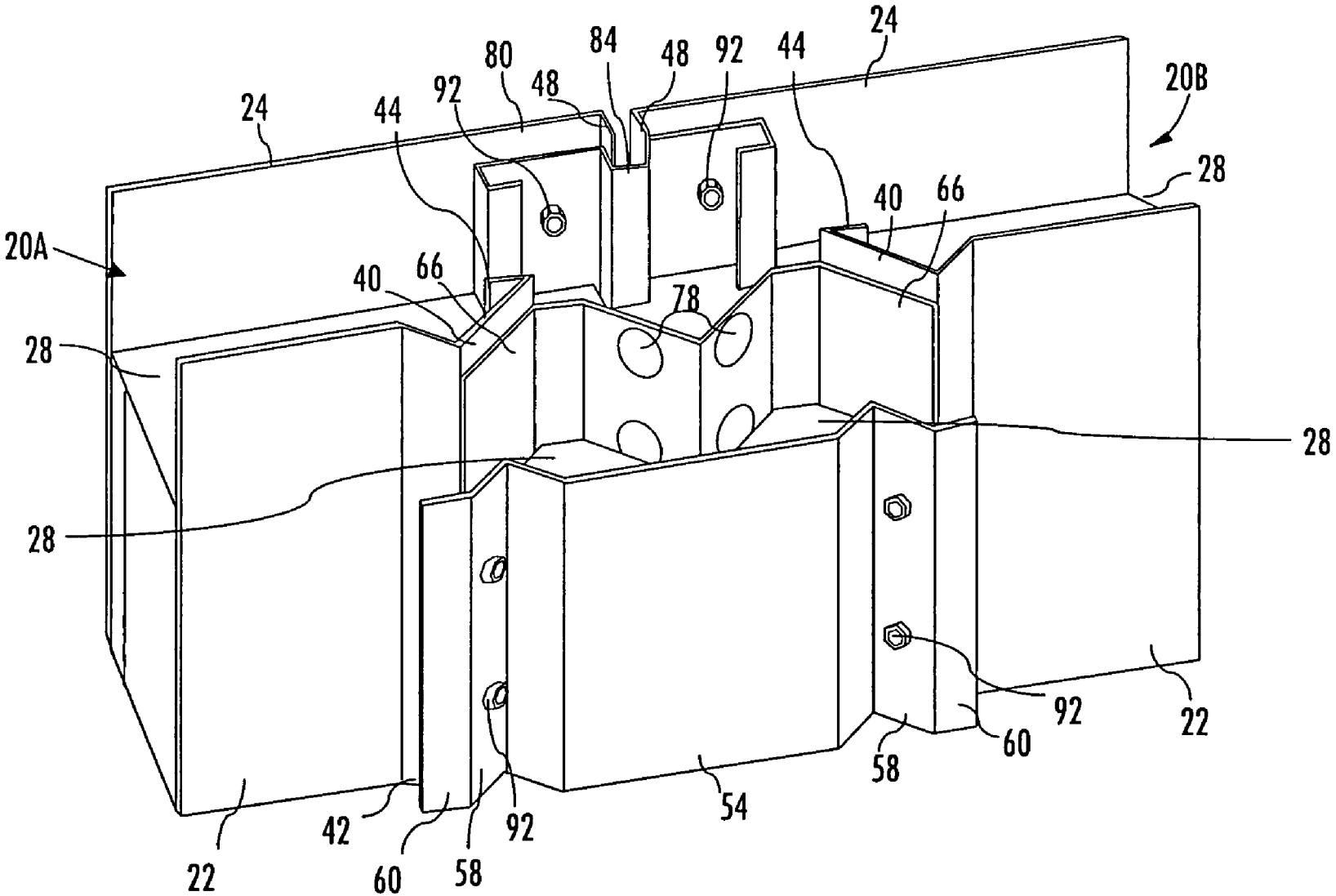
FIG. 3 is a perspective view of wall panels connected to a structural panel.

A connected wall assembly is illustrated in FIG. 3. The assembly comprises adjacent panels 20A and 20B, each comprising a first panel member 22 and second panel member 24. The connector 80 receives flanges 48 of the panels 20A-B in the groove 84 and is secured to the panels 20A-B by suitable structure such as fasteners 92. The fasteners 92 can be bolts, rivets, screws, or other suitable fastening structure. The facing member 54 is positioned with the angled connection portions 58 adjacent the angled flange portions 66 of the channel member 62. These can be positioned adjacent the angled flange portions 40 of the first panel member 22 and the connections can be secured by suitable fasteners 92. Flange portions 60 of the facing member 54 are substantially parallel to the wall direction and form an included angle with angled flange portions 42 of the first panel members 22. This space can be filled with a suitable sealant such as calking. In this manner, a tight seal is provided in the interior space between the first panel members 22 and second panel members 24, and between the structural column 50 and panel members 20.

Figure 4:
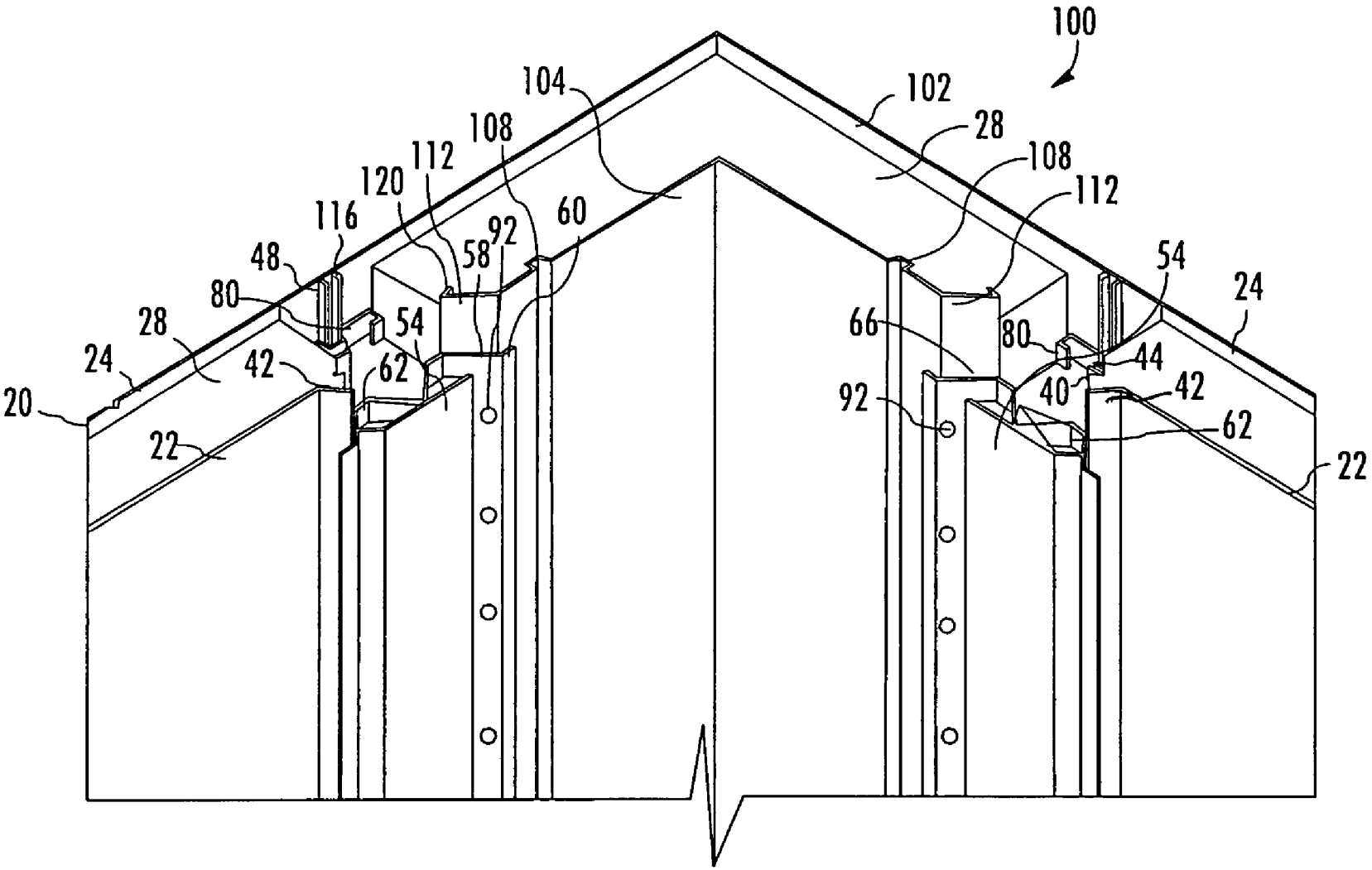
FIG. 4 is a perspective view of a corner assembly connected to wall panels.

Other wall system members can be provided for particular construction purposes. There is shown in FIG. 4 a corner assembly 100 having an outer panel facing member 102 and an inner facing member 104, both in the shape of a corner. It will be appreciated that this corner member 100 could be duplicated into an arch, an irregular curve, or any other suitable shape. In the example shown, the corner assembly 100 is in the form of a 90° angle and the outer panel member 102 and inner facing member 104 are positioned in spaced-apart relation with insulating foam 28 therebetween to avoid thermal bridging. Inner facing member 104 can have grooves 108 in order to better adhere to the foam 28 and improve corner structural stiffness. The inner facing member 104 can have an angled connection portion 112 for receiving fasteners 92 to connect to the angled connection portion 58 of the facing member 54 of the structuring column 50. The angled portion 66 of the channel member 62 is also connected by the fasteners 92 to the angled connection portion 58 and the angled connection portion 112. Flanges 60 of the facing member 54 can be used to seal the facing member 54 against the inner facing member 104 of the corner assembly 100 by calking or other sealing materials. A connector 80 can be used to engage flange 48 on panel 20 as previously described. A flange 116 can be provided on the outer panel member 102 in order to engage the connector 80. An inwardly-directed flange 120 can be provided adjacent the angled portion 112 in order to engage the foam 28.

Figure 5:
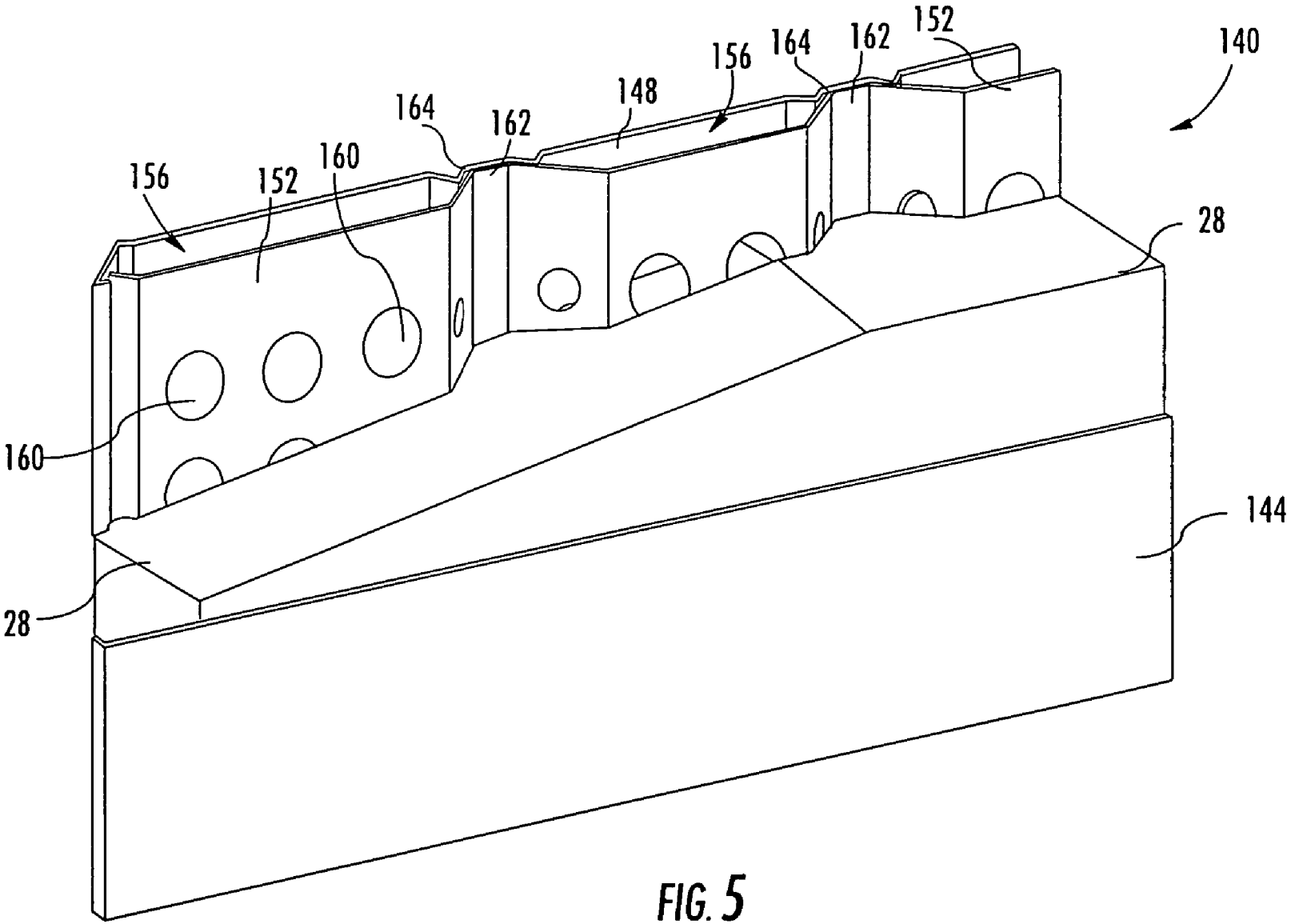
FIG. 5 is a perspective view, broken away, of a header/sill assembly.
Figure 6B:
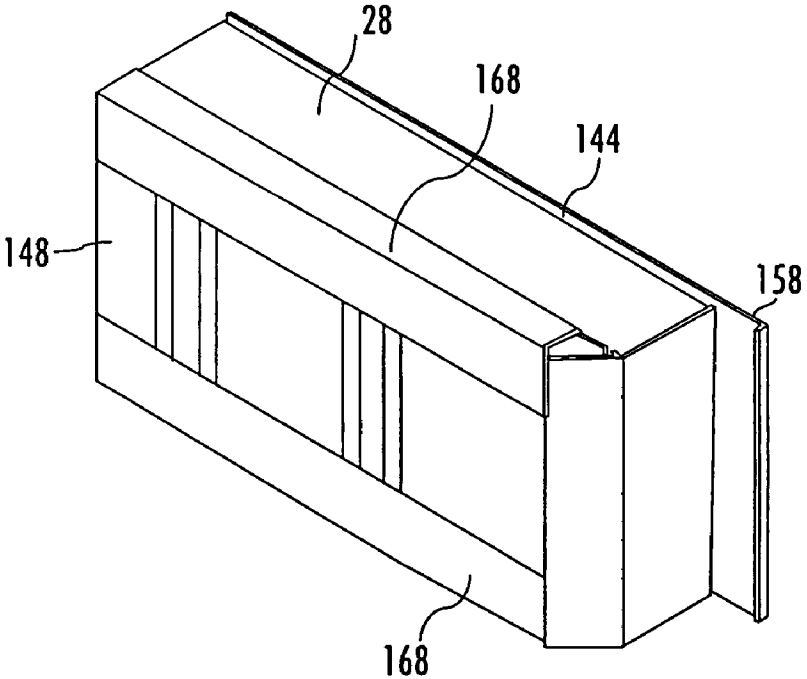
FIG. 6B is a perspective view of a header/sill assembly in a second configuration.
Figure 6A:
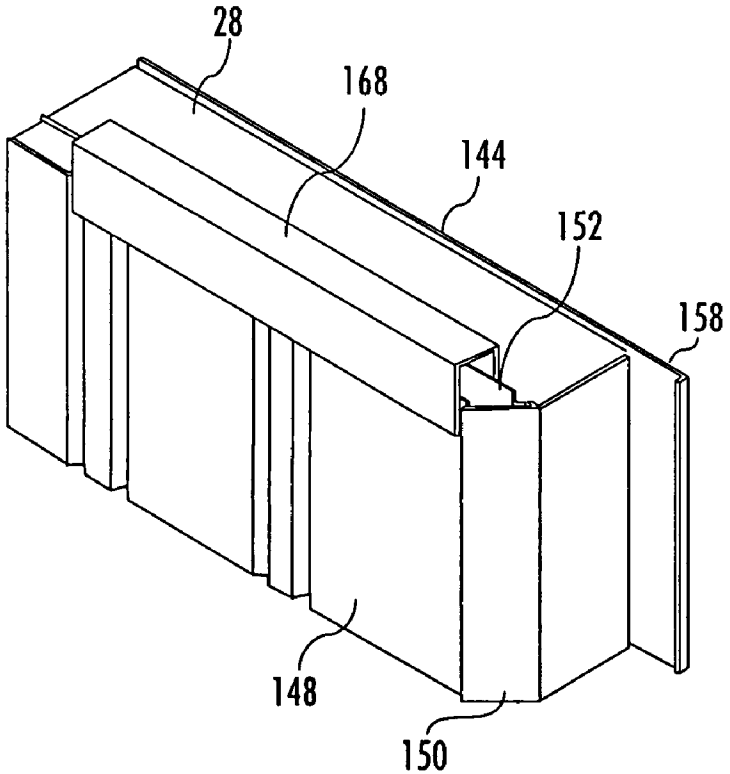
FIG. 6A is a perspective view of a header/sill assembly in a first configuration.
Figure 7B:
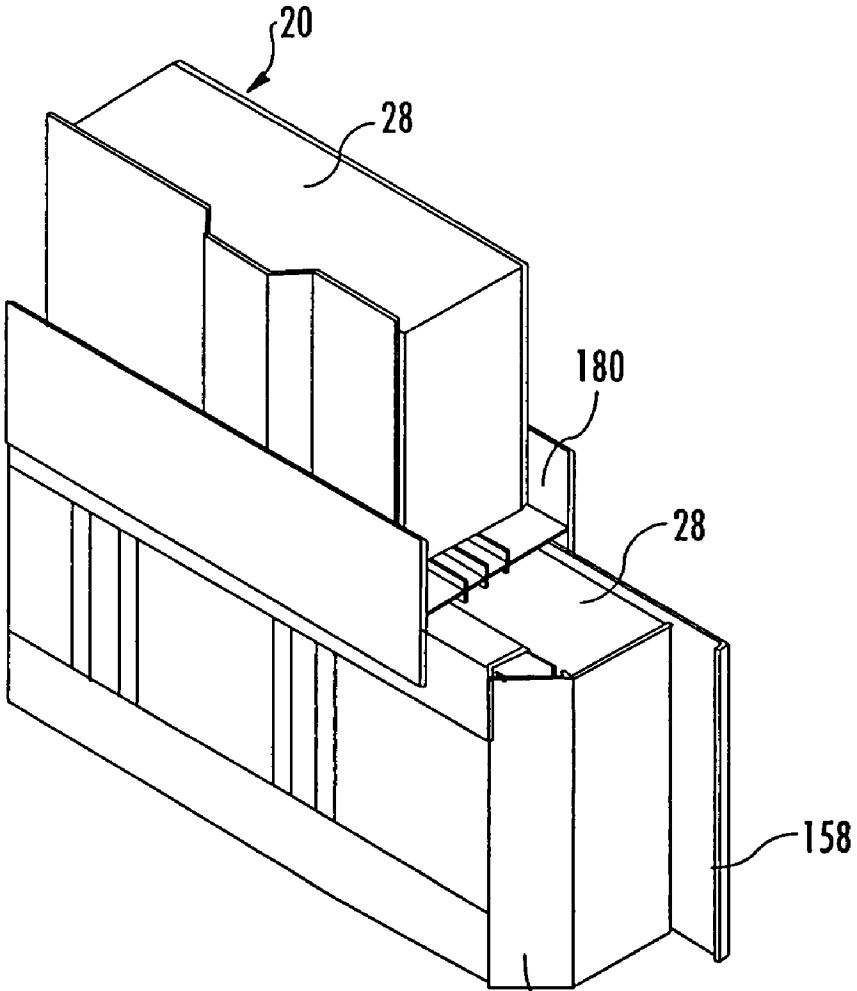
FIG. 7B is a perspective view of a header/sill assembly with a connector and wall panel.
Figure 7A:
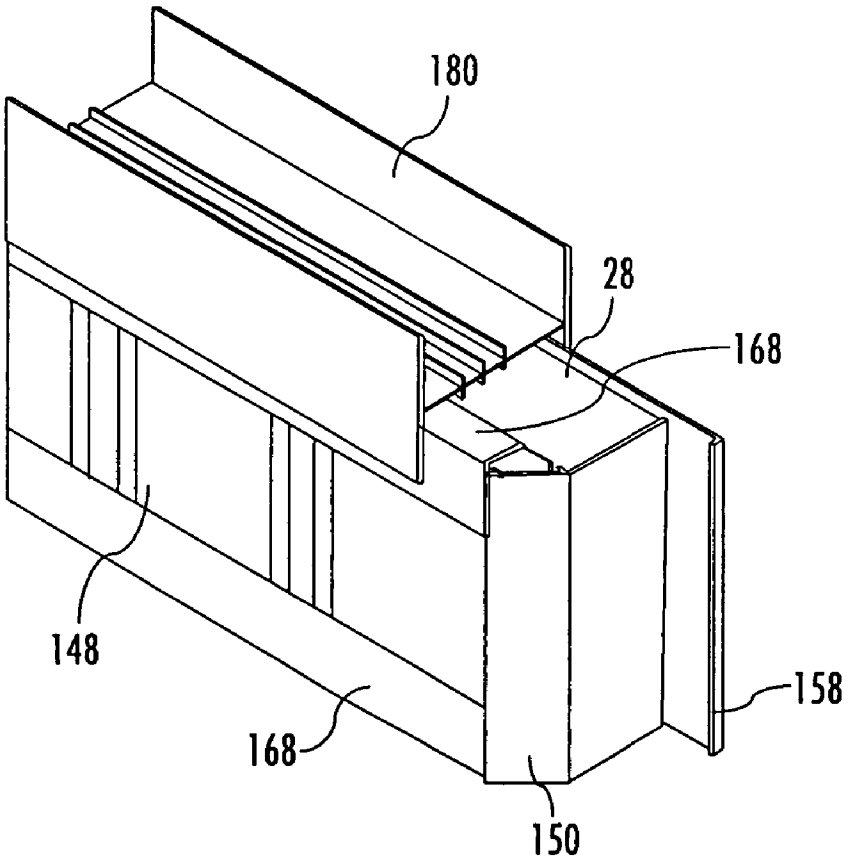
FIG. 7A is a perspective view of a header/sill assembly with a connector.

Window and door frames require additional strengthening and a window/door header and/or sill assembly 140 is shown in FIGS. 5-7. The assembly 140 includes an inner facing panel 144 and an outer panel 148. The panel 148 can include a channel member 152 in order to form channels 156 capable of receiving insulating foam 28. A plurality of apertures 160 can be provided in the channel member 152 in order to permit the foam 28 to be positioned within the channels 156. Various engagement structure can be provided to engage the channel member 152 to the outer panel member 148 including tongue portions 162 and groove portions 164. A C-shaped track member 168 can be provided to secure the space over the outer panel member 148 and channel member 152 (FIG. 6A). Another track member 168 can be provided on opposing edges of the outer panel member 148 and channel member 152 (FIG. 6B). The outer panel member 148 can have an angled flange 150. The inner facing member 144 can have a flange 158 for sealing to adjacent system columns. Flange 150 is used to connect with the structural column flange 66 as in FIG. 3.

The header assembly 140 can be used to construct a window sill. An H-shaped connector 180 (FIG. 7A) can be provided to fit over the header assembly 140 and receive a panel member 20 (FIG. 7B) to make the height connection between the header assembly 140 and the wall panels 20.

Figure 8:
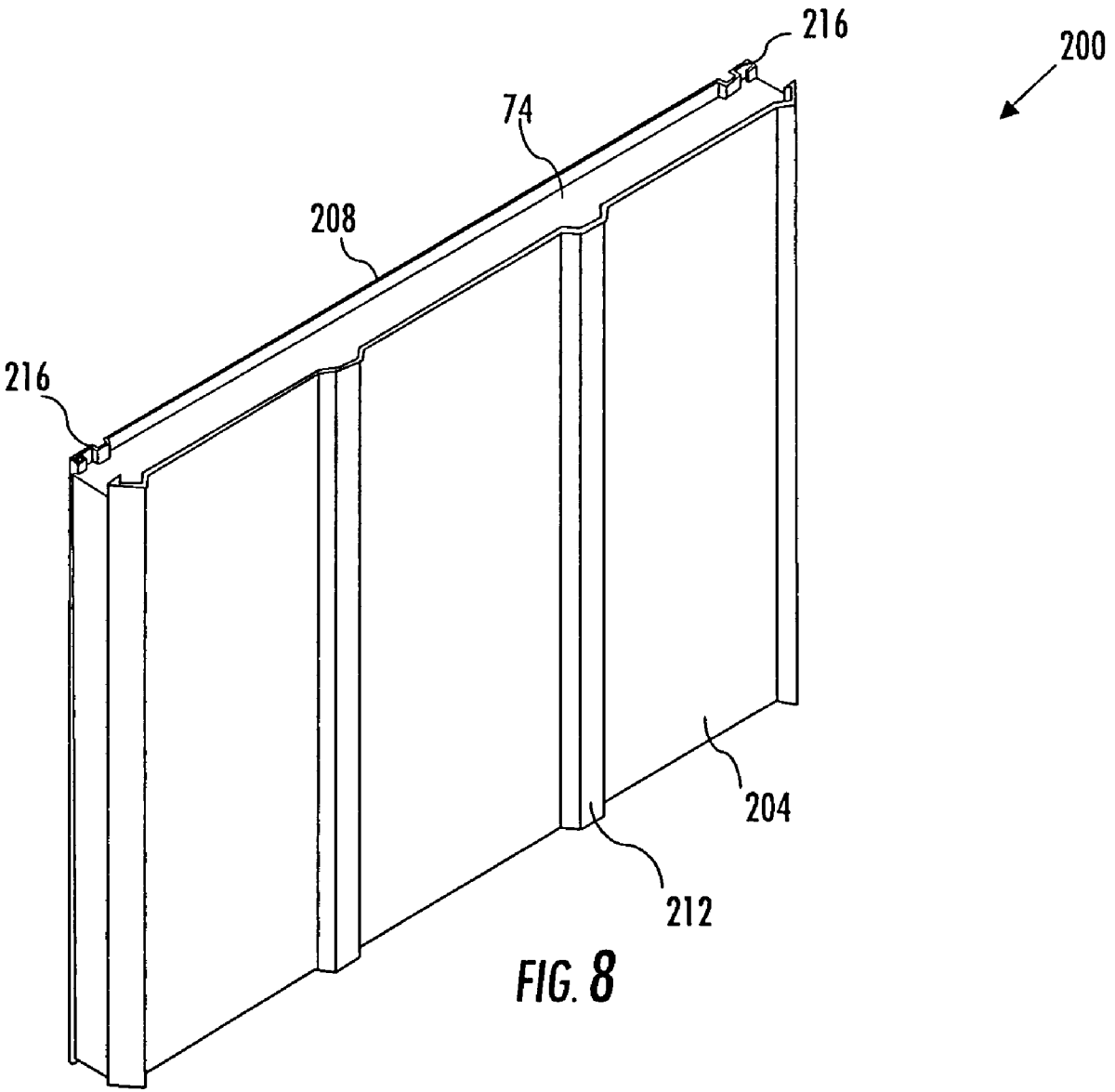
FIG. 8 is a perspective view of an alternative wall panel construction.
Figure 9:
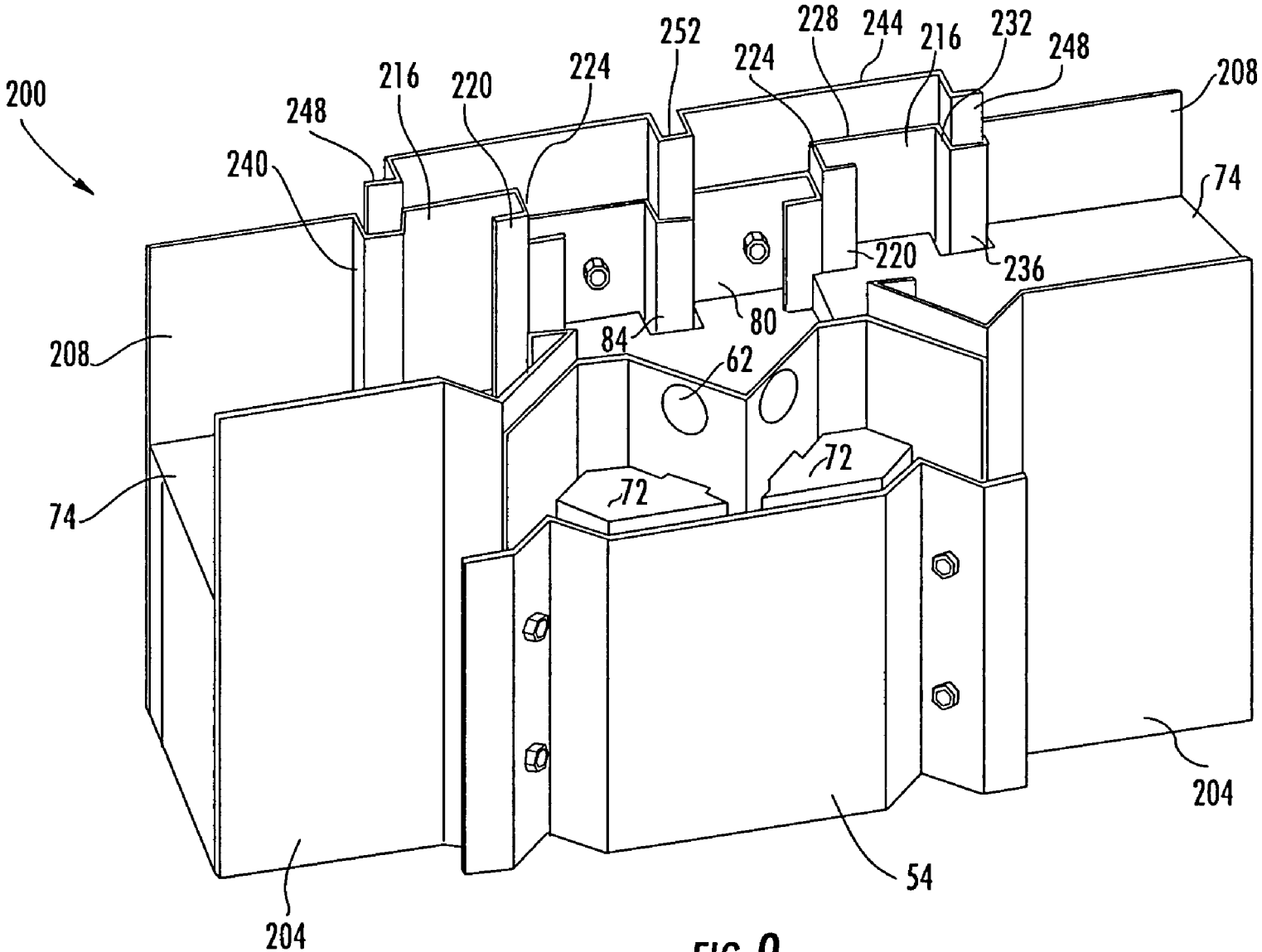
FIG. 9 is a perspective view of an alternative wall panel, connector and structural column configuration.

Alternative configurations are possible. In FIG. 8 there is shown a wall panel 200 having a first panel member 204 and a second panel member 208 with foam 28 therebetween. Spaced apart ridges 212 can be provided as previously described. Alternative connection structure in the form of a C-shaped channel member 216 (FIG. 9) is provided. The connection 216 includes an inwardly directed flange 220, a side flange 224, an outer channel member 228, a side flange 232, an inner groove member 236, and a side groove member 240. A connector 244 includes side flange members 248 and a central protrusion 252. The connector 80 rests between side flanges 224 and the groove 84 receives the protrusion 252 of the connector 244. Fasteners 92 can be used to connect the connector 244 to the connector 80 and the second panel member 108 (not shown in FIG. 9). The flanges 248 of the connector 244 rest in the grooves formed by the flanges 232, 236, and 240. Inwardly directed flanges 220 engage foam 28. The construction can be used as part of a structural column connection with inner facing member 54 and channel member 62 as previously described. Flanges 224 abut the sides of connector 80.

Figure 10:
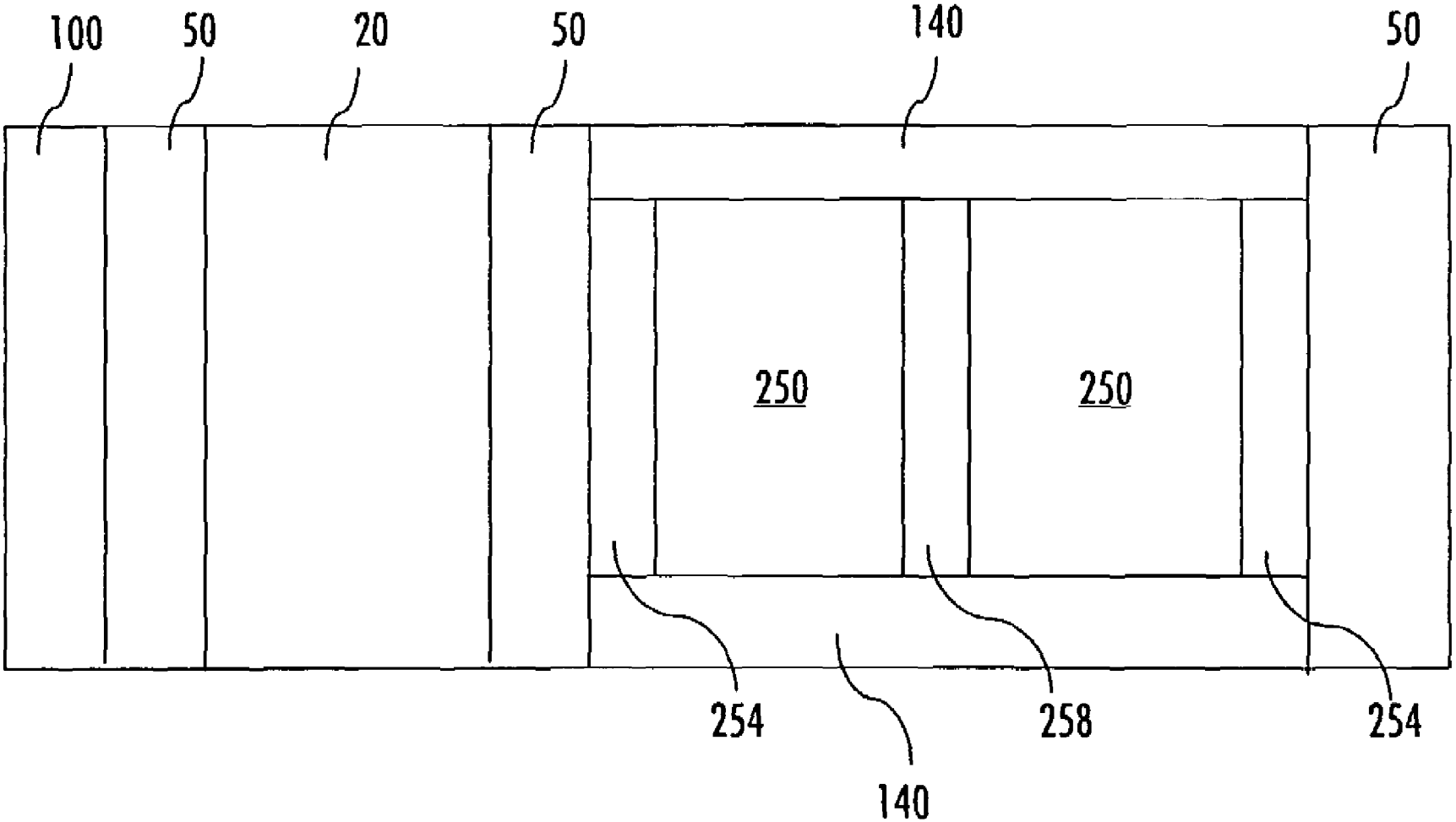
FIG. 10 is a side elevation of a wall configuration according to the invention.

Various constructions are possible with the panel members of the invention. In FIG. 10 there is shown an exemplary construction in which a panel 20 adjoins a structural column 50 and a corner assembly 100. A header/sill assembly 140 is provided above and below the window opening 250. Window filler members 254 and window breaker 258 can be provided to size and configure the window for various window constructions. The window filler members 254 and window breaker 258 can be panelized constructions with outer metal panels and insulating foam cores.

Figure 11:
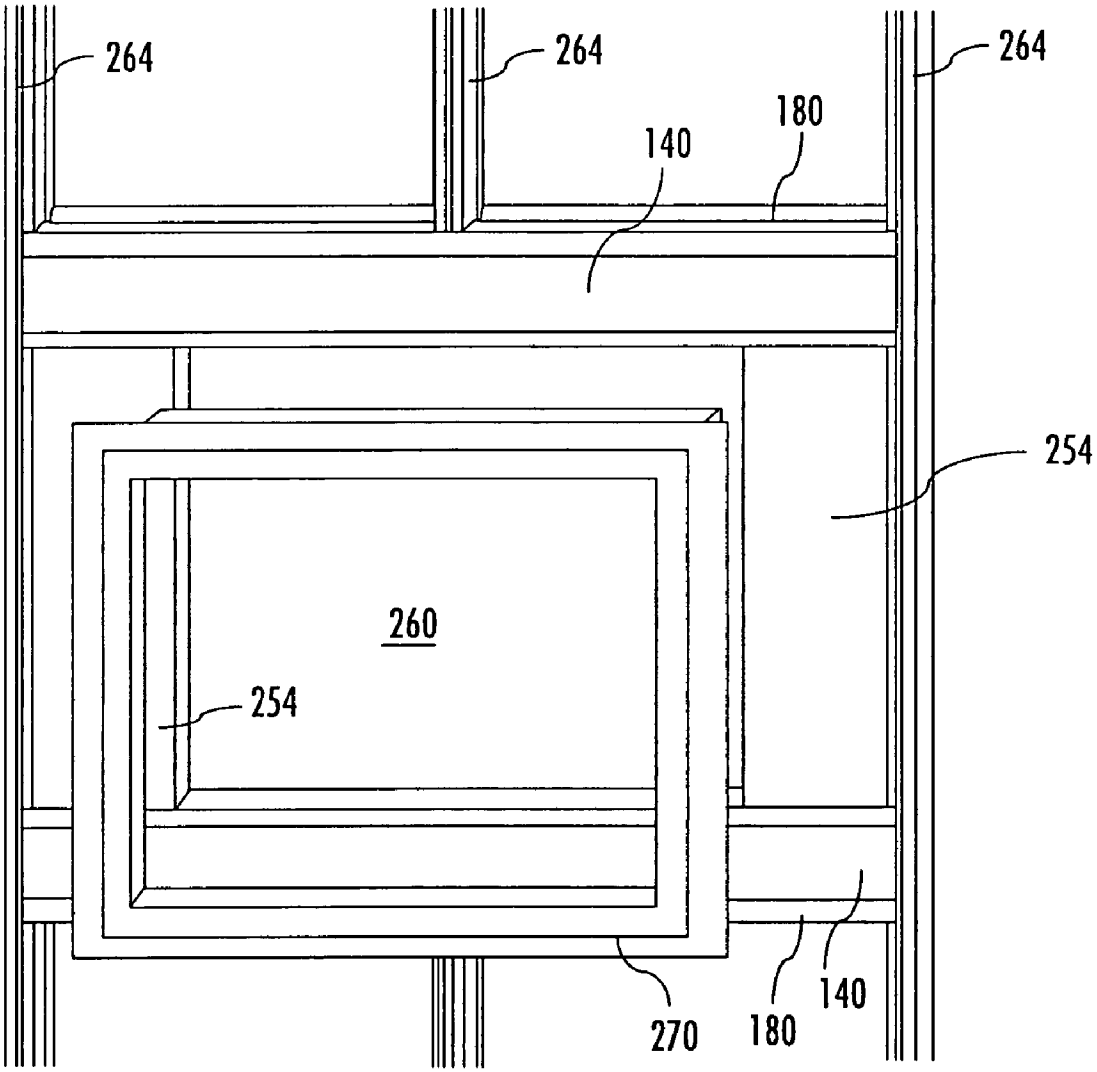
FIG. 11 is an exploded view of a window/window frame configuration according to the invention.

An alternative window is shown in FIG. 11. Header/sill assemblies 140 are provided above and below the window opening 260. Panels on top of the system header or under the system sill columns 264 are installed with the use of the H-connector 180. A window frame 270 is positioned in the window opening and joined to window fillers 254.

Figure 12:
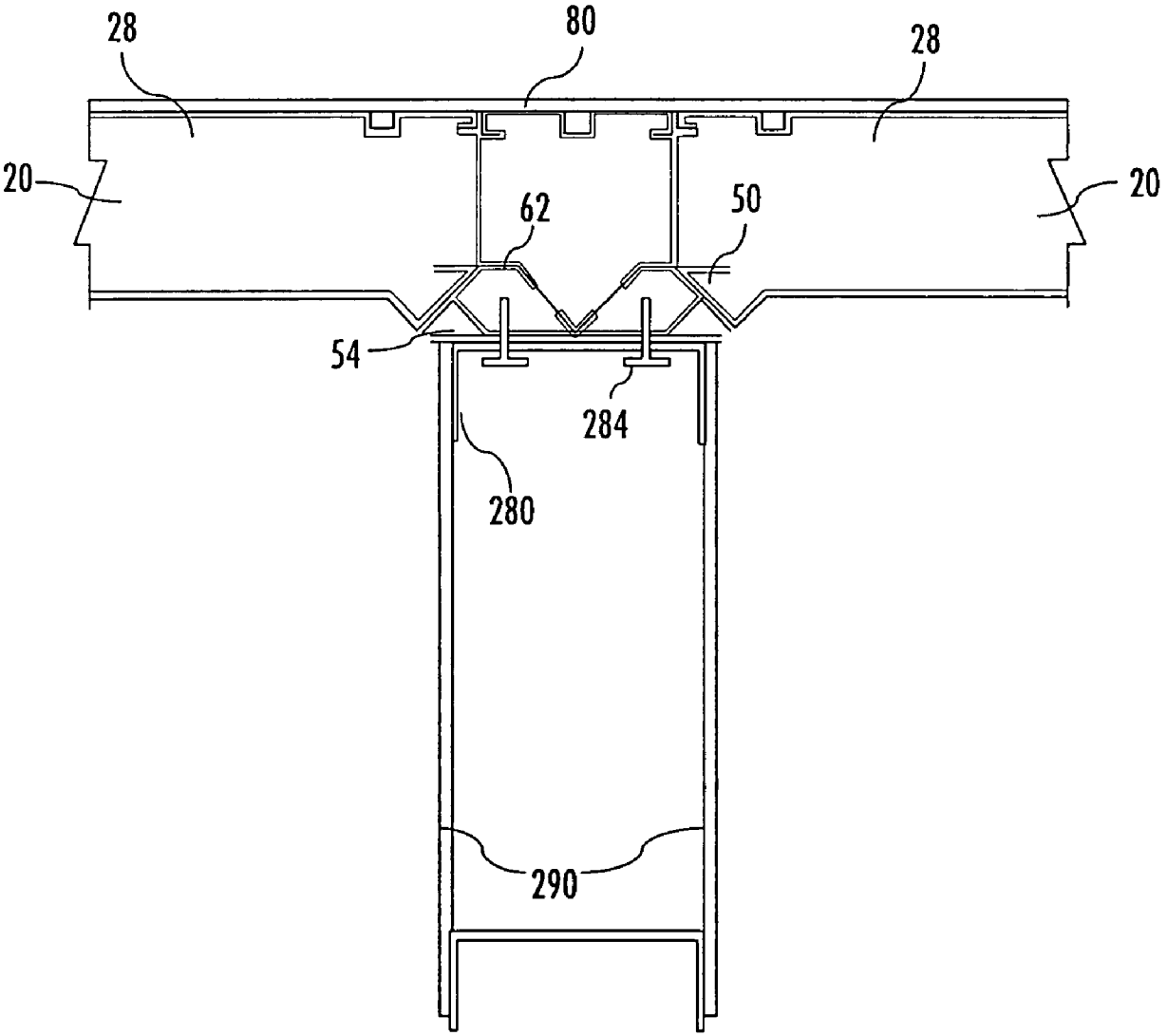
FIG. 12 is a cross section illustrating a wall partition connection.
Figure 13:
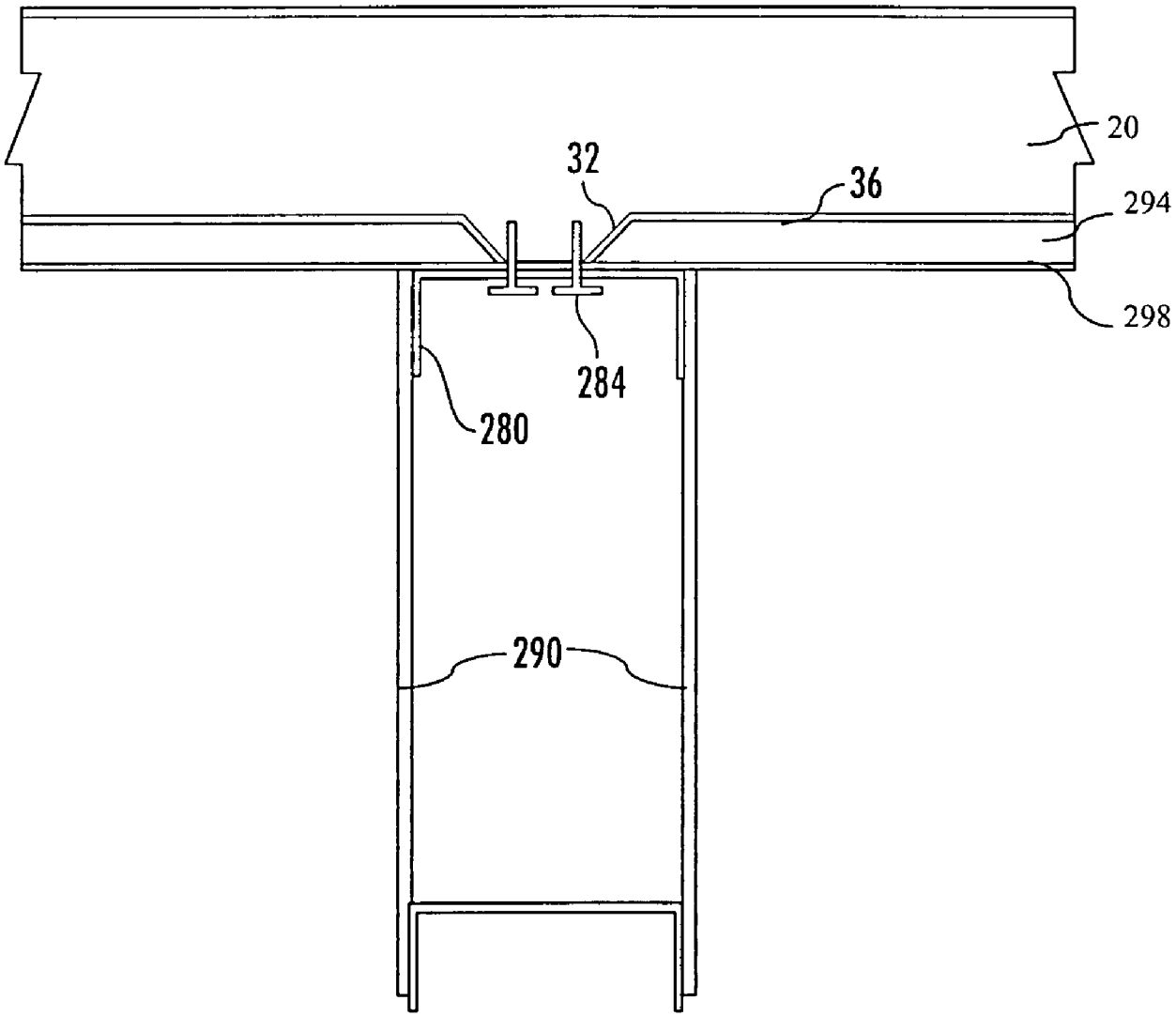
FIG. 13 is a cross section illustrating an alternative wall partition connection.

A wall partition on a column is shown in FIG. 12. The structural column 58, including connector 80, inner facing member 54, and channel member 62, is connected to panels 20 as previously described. Foam 28 fills the panels 20. A C-shaped wall connector 280 is attached to the structural column 50 using fasteners 284, and wall members 290 can be secured to the wall connector 280 by suitable fastening structure. There is shown in FIG. 13 a wall partition connection in which the C-channel member 280 is connected to ridges 32 of the panel 20, and illustrates the manner by which the ridges 32 function in the manner of studs in traditional wood construction systems. The space 294 between the gypsum wall 298 and the panel member 36 can be used to run electrical lines, plumbing, a moisture barrier, or left as an open space for purposes of ventilation.

Figure 14:
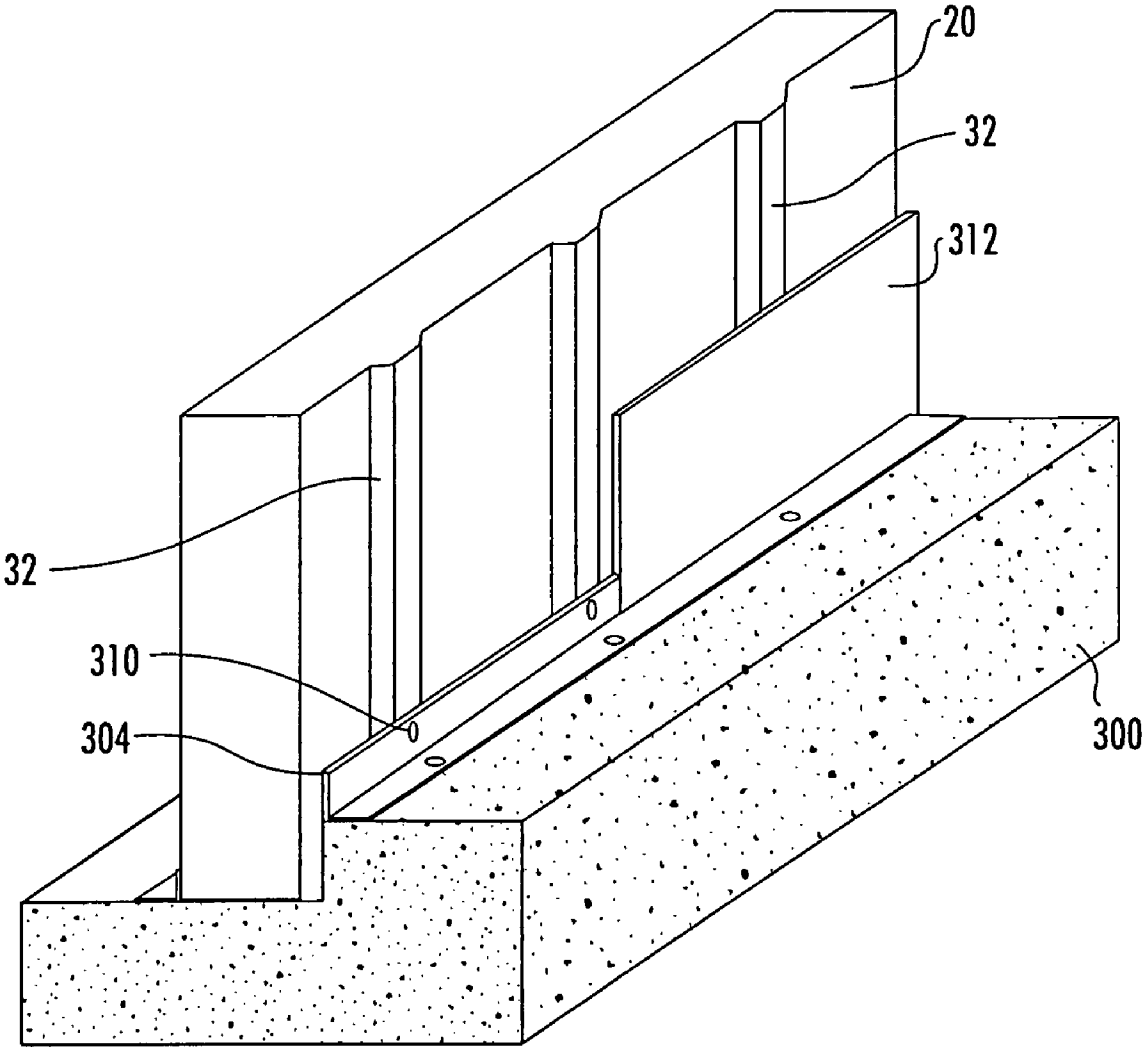
FIG. 14 is a perspective view of a wall/foundation connection.

The wall system of the invention can be utilized to construct buildings rapidly and efficiently. There is shown in FIG. 14 a foundation 300 in which the building panels 20 are secured to the foundation 300 by use of angle bracket 304 or other suitable connecting structure. The angle bracket 304 can be connected by fasteners 310 to the ridges 32 in the manner of studs. Wall board, such as gypsum board 312 can similarly be connected to the ridges 32 by suitable fasteners.

Figure 15:
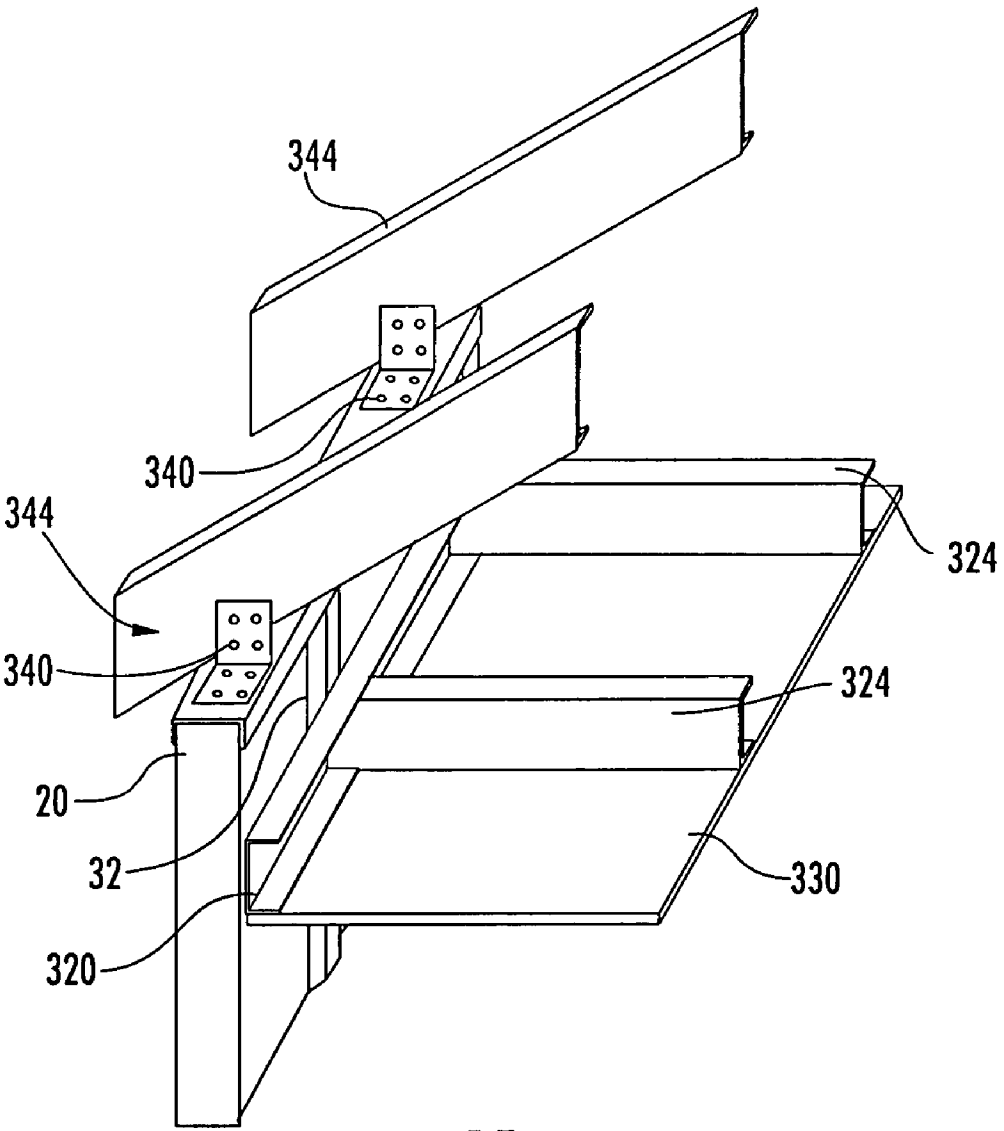
FIG. 15 is a perspective view of a wall/ceiling/roof construction.
Figure 16:
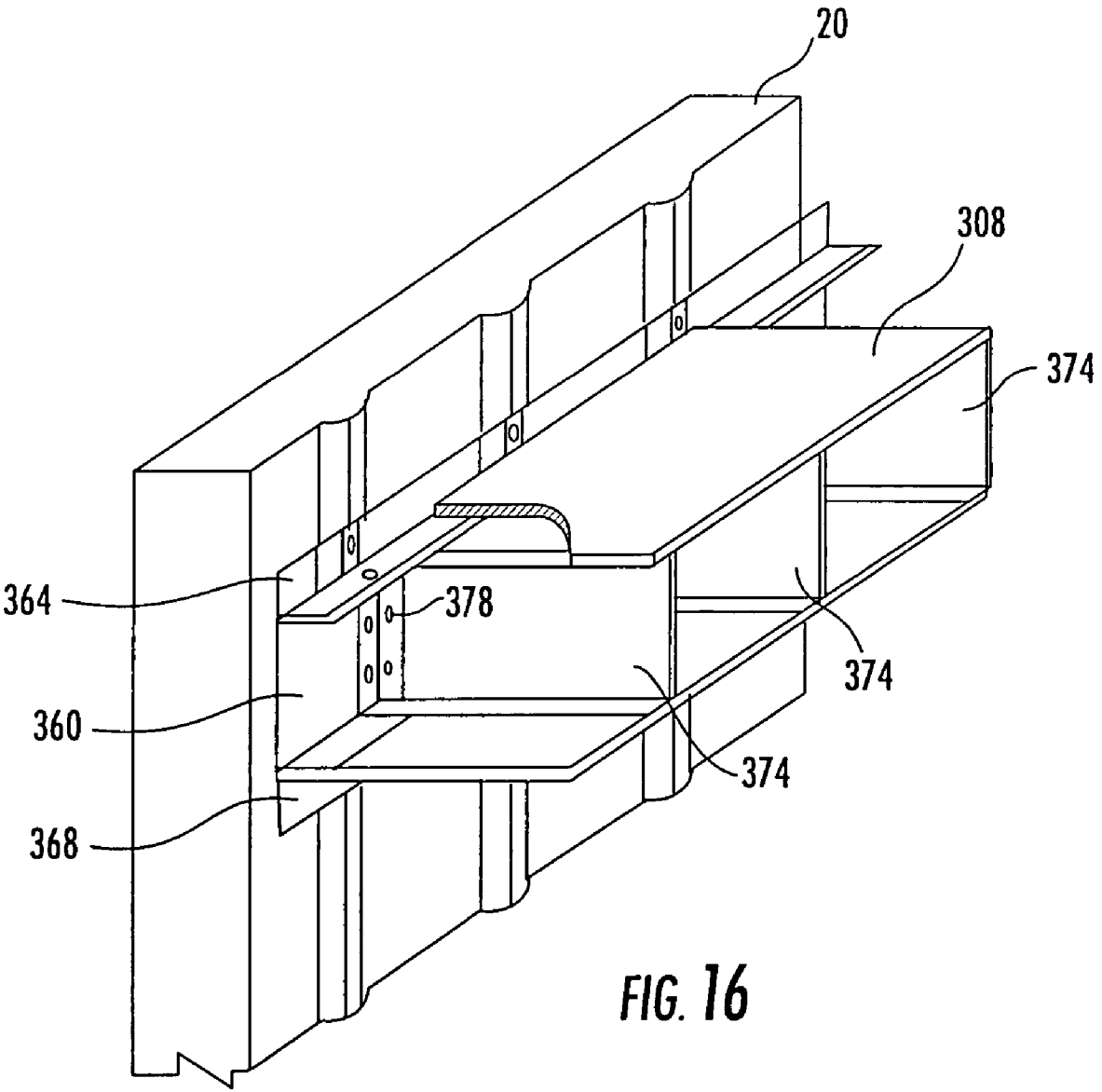
FIG. 16 is a perspective, partially broken away, of a floor support assembly.

There is shown in FIG. 15 a manner of constructing a ceiling and a roof in which a C-channel member 320 is secured to the ridges 32 of wall panels 20. Ceiling supports such as C-channels 324 can be secured in the C-channel member 320 and ceiling panels 330 can be suspended from the roof supports 324 in traditional fashion. Strapping 340 can be secured to the top portions of the panels 20 and engaged to roof trusses 344 to form the roof of the structure. There is shown in FIG. 16 a floor assembly in which a C-channel 360 is joined to panels 20 by suitable structure such as angle brackets 364, 368. Floor supports 374 can be joined to the C-channel 360 by bracket 378 and support flooring 308.

The weight of the basic panels 20 can be controlled so as not exceed 80 lbs. The panels can be pre-cut and pre-wired at the factory for specific building designs, with each panel numbered for quick assembly on site. Because the expansion options are pre-designed and engineered, the structural integrity and energy efficiency of the envelope will be preserved. In addition, the panels are recyclable, and can be constructed in one building form, then later dismantled and reconstructed into another. A catalogue of building plans can be developed to provide pre-designed expansion options to accommodate the anticipated growth needs of the owner. The proposed SIP technology which is metal panels with a closed-cell polyurethane core resolves negative attributes of the traditional OSB clad SIP. It is impervious to termites and moisture deterioration. The panels are constructed of noncombustible materials, and the wind tolerance of the envelope is expected to materially outperform traditional wood frame structures. The panel itself can be 4" thick (4.5" with gypsum board interior finish), therefore, compatible with standard construction components. The panel can be lightweight at 2 to 2.3 lbs. per square foot. The width of the panel can be in 4' widths, or 2' widths or any other desired widths. The production of the panels can be a continuous line, so that the panels can be manufactured in any length. Due to the panels light weight, 1&2 story buildings would not require a crane. The interlocking panel connections will make the wall system virtually air and moisture tight.

The proposed building envelope system will eliminate or significantly reduce moisture penetration and following it accumulation and mold growth. An additional advantage the light-gage steel skin sandwich structure will be its superior wind performance. Similar panelized technologies proved that they could withstand 150 mph winds when tested in lab conditions. Structures that can withstand higher windstorm conditions will provide significant benefits to homeowners through fewer losses due to wind damage. In addition, because the panels are pre-cut at the factory, the construction waste is significantly reduced resulting in lower building costs and significant reductions in landfill waste. Also, because the panels are recyclable and can be dismantled and reassembled in a difference structure thus reducing demolition waste, the positive impact on landfills is even greater.

From the structural strength perspective, the proposed technology is based on the concept of foam-core sandwich panels which have been successfully utilized by many different industries during past decades. The panel connecting seams and unique panel skin foldings further increase panel structural stability and work in similar way as conventional studs. The interlocking panel connections feature self-sealing seams, which make the wall system virtually air and moisture tight. The panel's metal skins enhance the overall structure through improved structural stability, by creating an impermeable barrier for foam blowing agent and reduction of foam aging effect, act as a radiant barrier, and provide a termite and moisture resistant panel facing.

This invention can be embodied in other forms without departing from the spirit or essential attributes thereof and, accordingly, reference should be had to the following claims, rather than to the foregoing specification, as indicating the scope of the invention.

We claim:

1. A wall system, comprising a two wall members, and a structural column, each said wall member comprising: a first metal panel having first and second sides opposing each other; a second metal panel having third and fourth sides opposing each other; an insulating core between the first panel and the second panel; at least one of the first panel and the second panel comprising ridge portions; the second panel being wider than the first panel, wherein the first and third sides are laterally offset from each other, and wherein the second and fourth sides are laterally offset from each other, said first, second, third and fourth sides having flanges directed inwardly in the direction of said core; and said structural column being a separate component from the wall members and connectable thereto, said structural column comprising: a facing member having angled side connection portions adapted to mate on one side with the flange of the first side of the first metal panel of one of said wall members, and adapted to mate on the other side with the flange of the second side of the first metal panel of the other of said wall members; and a channel member having angled connection portions connected to said angled side connection portions of said facing member and to said flanges of said first and second sides of said wall members, and channel portions forming channels between said facing member and said channel member, said facing member and said channel member forming a structural beam and said facing member covering from view said flanges of said first and second sides of said wall members; and a connector, said connector having a groove for receiving the flange of third side of the second metal panel of one of said wall members, and the flange of the fourth side of the second metal panel of the other of said wall members, thereby forming a moisture resistent seal; and an insulating foam positioned in said channels and between said channel member and said connector, said channel member having a plurality of apertures through which the insulating foam extends, whereby the insulating foam secures the structural column together while thermally insulating said structural column.

2. The wall system of claim 1, further comprising a wall finish material mounted to said ridges and a phase change material in the cavity between said first panel and said wall finish material.

3. The wall system of claim 1, further comprising a wall finish material mounted to said ridges and a radiant barrier installed on the surface of the first panel and facing the cavity between said first panel and said wall finish material.

4. The wall system of claim 2, wherein said phase change material is impregnated in at least one selected from the group consisting of fiberboard and foam board.

5. The wall system of claim 1, further comprising foam in said channels.

6. The wall system of claim 1, further comprising at least one connector for connecting a wall member to another wall member, said connector comprising a groove, said groove receiving flanges on said wall members.

7. The wall system of claim 5, further comprising at least one corner member, said corner member having at least one flange for engaging said connector.

8. The wall system of claim 7, further comprising a corner facing member, said corner facing member comprising and angled portion for mating with angled portions of adjacent wall system components.

9. The wall system of claim 1, wherein said insulating core is foam.

10. The wall system of claim 9, wherein said foam is closed cell polyurethane foam.

11. The wall system of claim 10, wherein said foam comprises an opacifier.

12. The wall system of claim 1, wherein said ridges are vertically oriented.

13. The wall system of claim 12, wherein said ridges are spaced apart 16"or 24" on center.

14. The wall system of claim 1, further comprising a header assembly, said header assembly comprising a channeled panel portion and a flat panel portion.

15. The wall system of claim 14, wherein said channeled panel portion of said header assembly comprises first and second members, said first and second members having mating portions.

16. The wall system of claim 14, wherein said header assembly comprises a C-shaped track for engaging an edge of said channeled panel portion.

17. The wall system of claim 14, wherein said header assembly comprises an H-shaped panel connector member.

18. The wall system of claim 1, wherein said metal is steel or aluminum.

19. The wall system of claim 1, further comprising a plurality of apertures for positioning insulating foam in interior spaces of the wall system.

* * * * *